United States Patent [19]

Scholl

[11] Patent Number: 4,905,618

[45] Date of Patent: Mar. 6, 1990

[54] METHOD FOR SEWING A COLLAR ON TO A BODY OF AN ARTICLE OF CLOTHING

[75] Inventor: Hans Scholl, Oerlinghausen-lipperreihe, Fed. Rep. of Germany

[73] Assignee: Kochs Adler Aktiengesellschaft, Fed. Rep. of Germany

[21] Appl. No.: 279,208

[22] Filed: Dec. 2, 1988

Related U.S. Application Data

[63] Continuation-in-part of Ser. No. 235,291, Aug. 23, 1988.

[30] Foreign Application Priority Data

Sep. 10, 1987 [DE] Fed. Rep. of Germany ..... 3730406

[51] Int. Cl.[4] ..... D05B 97/00; D05B 3/00

[52] U.S. Cl. ..... 112/262.3; 112/121.12; 112/104; 112/121.14

[58] Field of Search ..... 112/262.3, 265.1, 121.14, 112/121.12, 104, 121.15

[56] References Cited

U.S. PATENT DOCUMENTS

| | | | |
|---|---|---|---|
| 2,313,433 | 3/1943 | Golden | 112/104 |
| 3,839,973 | 10/1974 | Cummins et al. | 112/121.14 |
| 4,494,470 | 1/1985 | Fischer | 112/121.12 |
| 4,503,789 | 3/1985 | Scholl | 112/121.14 |
| 4,513,677 | 4/1985 | Scholl | 112/262.3 |
| 4,696,242 | 9/1987 | Scholl et al. | 112/121.14 |
| 4,736,695 | 4/1988 | Junemann | 112/121.14 X |

FOREIGN PATENT DOCUMENTS 1115113 0/0000 Fed. Rep. of Germany .
1460077 0/0000 Fed. Rep. of Germany .

*Primary Examiner*—H. Hampton Hunter
*Attorney, Agent, or Firm*—Laff, Whitesel, Conte & Saret

[57] ABSTRACT

To produce a collar, which consists of two lower collar parts and if necessary an upper collar, on the body of an article of clothing, the edge of the body and, if necessary, the corresponding marginal zone of the upper collar are arranged between the associated marginal zones of the two lower collar parts prior to sewing. Sewing with only one continuous closed seam then takes place.

8 Claims, 6 Drawing Sheets

METHOD FOR SEWING A COLLAR ON TO A BODY OF AN ARTICLE OF CLOTHING

This is a continuation-in-part of my application Ser. No. 235,291 "Method and Device for Sewing a Collar on to a Body of an Article of Clothing", filed Aug. 23, 1988.

FIELD OF THE INVENTION

The invention relates to a method of sewing a collar, formed by two lower collar parts and if necessary an upper collar, on to a body of an article of clothing, particularly a shirt or a blouse, a margin of the body of the article of clothing being arranged and held between associated marginal zones of the lower collar parts and sewn thereto, and marginal zones of the lower collar parts which are remote from the margin of the body being sewn together, between which marginal zones a marginal zone of an upper collar, if necessary, is arranged and held prior to sewing and to a device for carrying out the method, comprising a sewing head and at least one workpiece holder for receiving workpieces, the sewing head and workpiece holder being movable in a plane relative to one another to produce a seam for joining the workpieces.

BACKGROUND OF THE INVENTION

From a publication of the assignee, "SEWING TECHNOLOGY" 18/HB "Rational Manufacture of Shirts", RN-HB 173 E 18-0181-3 it is known practice to manufacture so-called two-piece collars in such a manner that an already prefabricated upper collar and two lower collar parts are sewn together. For this purpose the two lower collar parts are sewn to the upper collar, the two lower collar parts receiving between them the corresponding marginal zone of the upper collar. For the purpose of fitting the two-piece collar to the body of a shirt or blouse, the two lower collar parts are laid against the margin of the body of the shirt or blouse or the like so that they receive the latter between them. Then the collar consisting of the upper collar and lower collar parts is sewn to the body. This sewing process calls for some dexterity on the part of the sewer particularly since folds still end at the margin of the shirt body and the body and collar have to be positioned relative to one another with the aid of markings. This method of assembling the individual parts and fitting them together is time-consuming. Such a method of sewing an upper collar on to a body by means of two lower collar parts is also known from German Offenlegungsschrift 14 60 077 (unexamined published German patent application 14 60 077). If only a so-called stud collar is to be sewn on to the body, two corresponding lower collar parts are firstly sewn together, then positioned relative to the marginal zone of the body and then sewn together with the latter.

From German patent specification 11 15 113 it is known practice to provide in a sewing machine for sewing on labels or the like a press foot along the outer edges of which a seam is produced. To enable a closed seam to be produced in this case, the press foot is connected to a retaining bearing on the sewing machine by means of an angled lug. By pivoting the angled section through 180° the seam can have a closed design with a certain amount of overlapping to secure the seam.

SUMMARY OF THE INVENTION

It is an object of the invention to specify a method of the type as defined and a device for carrying out this method whereby the work involved in and time spent on sewing the collar on is reduced while at the same time quality is increased.

This problem is solved by arranging the edge of the body between the associated marginal zones of the two lower collar parts prior to sewing and by subsequently sewing together all parts with only one continuous closed seam.

The essence of the invention is that all the parts which are to be sewn together, i.e. the body of the shirt or blouse or the like, the two lower collar parts and the if necessary provided upper collar are positioned towards one another and held in such a manner that these parts can be sewn together with a single closed seam. First only two lower collar parts can be sewn together with the body of the article of clothing to form a stud collar. If in addition an upper collar is used, this is also sewn together with the body at the same time. The measures according to the invention result in a substantial increase in quality compared with the manual fitting of the collar on the body, a considerable reduction in costs being achieved at the same time by the reduction in work time.

In the process of sewing the single closed seam for fitting the lower collar parts to the shirt body and an upper collar to the lower collar parts, also the whole topstitch seam, i.e. the outer visible seam, of the upper collar can be produced without any special positioning and holding of the workpieces being necessary.

In a device as defined above according to the invention the workpiece holder has a first nest for receiving a first lower collar part, devices for receiving and positioning a body of an article of clothing and, if necessary, of an upper collar each particularly overlapping with the first lower collar part, a second nest for a second lower collar part, which nest is arranged above these devices and can be lowered towards them, and a holding device which is arranged above and can be lowered on to the second nest. The essence of the invention resides in the design of a workpiece holder for an automatic sewing machine which produces the closed seam by computer control.

Further advantages and features of the invention emerge from the following description of an exemplary embodiment, taken in conjunction with the drawing.

DESCRIPTION OF THE PREFERRED EMBODIMENT

Figure 1:
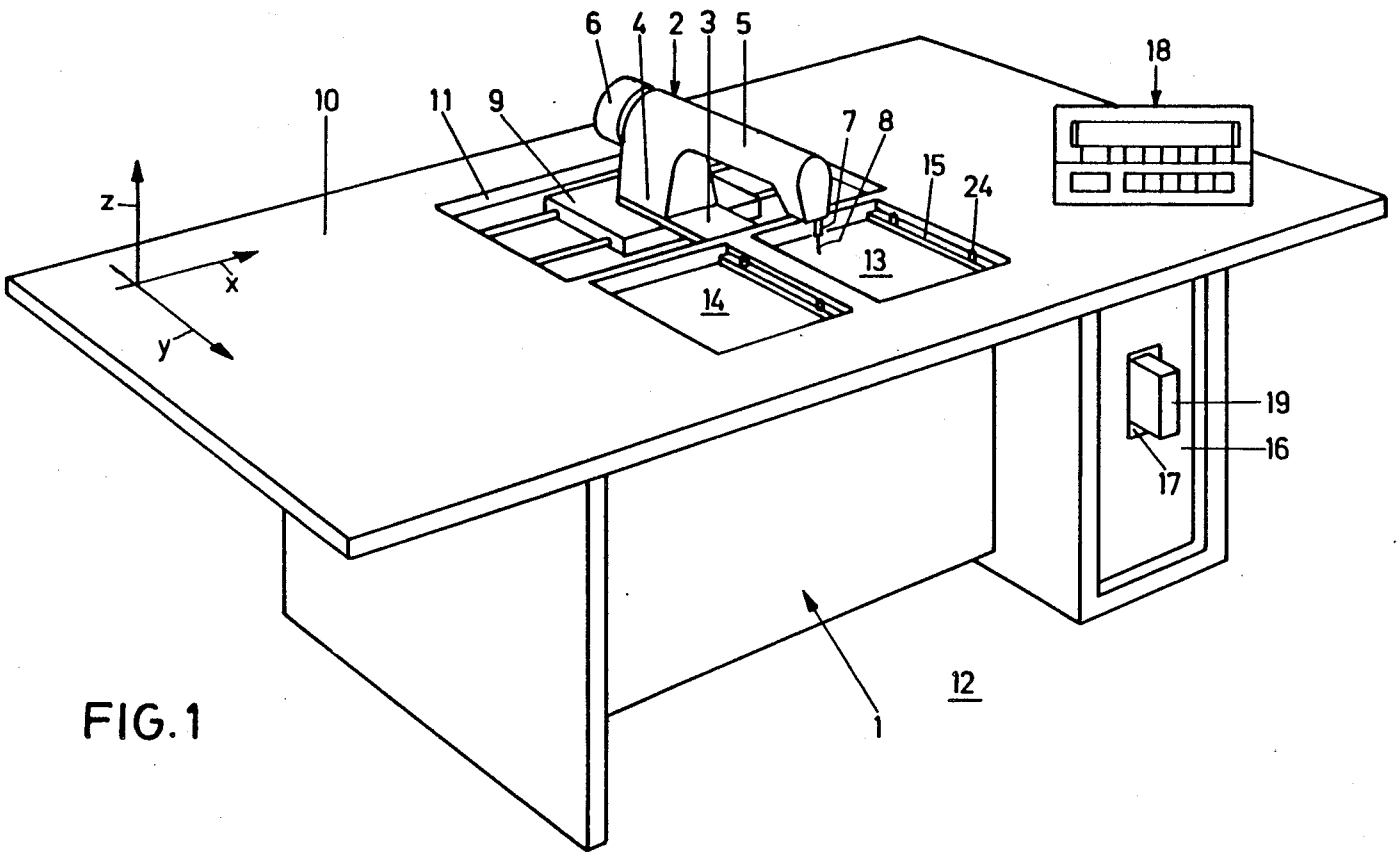
FIG. 1 shows an automatic sewing machine in perspective view with openings for receiving each workpiece holder.

In the case of the automatic sewing machine shown in FIG. 1 a sewing head 2 is arranged on a stand 1, the sewing head consisting of an arm-shaped base plate 3, a standard 4 rising vertically from this base plate and an upper arm 5 which in turn extends from this standard horizontally and approximately parallel to the base plate 3. Attached to the arm 5 is an electric drive motor 6 which drives a needle bar 7 and needle 8 with an up-and-down motion via an arm shaft (not shown) mounted in the arm 5. At the same time the needle bar 7 together with the needle 8, describes a movement in the z direction. A hook, which is driven synchronously with the needle bar 7 via drive elements inside the sewing head 2, is arranged in the conventional manner in the base plate 3. To form a stitch the needle 8 dips into a stitch hole formed on the base plate 3 so that the needle 8 and hook can cooperate as stitch forming tools.

The sewing head 2 is arranged on a carriage 9 which is drivably supported and mounted in the stand 1 in two directions perpendicular to one another, namely the x direction and y direction. The z direction runs perpendicular to the x and y directions. The x, y and z directions thus form a cartesian coordinate system.

In the plane over which the x and y directions extend, the stand 1 is covered by a work plate 10 provided with a recess 11, the extension of which in the x and y directions is such that the sewing head, with its standard 4 projecting through this recess 11, can be moved over its entire working range in the x and y directions. The base plate 3 of the sewing head 2 is situated below the work plate 10. Two openings 13, 14 for receiving workpiece holders, which are to be described in even more detail further on, are provided in the work plate 10—as seen from the operator's side 12—in front of the recess 11 for the sewing head 2. These openings 13, 14 are rectangular and surrounded by a supporting edge 15 for the workpiece holder.

A computer 16 with an input unit 17 is provided for controlling the automatic sewing machine. The computer functions are triggered manually by means of a control panel 18. Before a sewing operation commences, a data carrier 19, for example an EPROM, is inserted into the input unit 17 and the information contained thereon is read into the computer 16. The drives of the carriage 9, the drive motor 6 of the sewing head 2 and other standard sewing machine functions are controlled by the computer. The previously described and illustrated automatic sewing machine is known from U.S. Pat. No. 4,696,242, to which specific reference is made. In particular, the automatic sewing machine can have the supporting plate provided below the workpiece holder in the previously mentioned publication and the supporting strip arranged between this supporting plate and the workpiece holder.

Each workpiece holder 20, which can be detachably fitted into the openings 13, 14, has a frame 21 which is adapted to the opening 13 or 14 and the sides 22 of which extending in the y direction have centering bores 23. Centering pins 24 mounted on the respective supporting edge 15 of each opening 13 or 14 engage in these bores so that precise alignment of each workpiece holder 20 relative to the work plate 10 is possible. The workpiece holders 20 are secured to the work plate 10 also by means of retaining elements, e.g. bar tacks, screws or permanent magnets. The sides 22 of the frame 21 are connected to one another in the x direction by means of a web 25 on the side remote from the operator's side 12. A plate 26 is attached to the underside of the frame 21. On the side facing the operator's side 12, the sides 22 of the frame 21 are connected to one another by means of a T-shaped cross arm 27 which is mounted below the plate 26 and extends in the x direction, so that from the operator's side the plate 26 is not overlapped by parts of the frame 21.

A first nest plate 28, which has a recess serving as the first nest 29, is mounted flush on the plate 26. A first lower collar part 30 is inserted in this first nest 29. The path of the edge 31 of the first nest 29 corresponds exactly to the outer form of the first lower collar part 30 so that the latter is mounted so as to be laterally fixed in the first nest 29.

A recess 32 having an edge 33 running equidistantly to the edge 31 is formed in the plate 26 below the first nest 29. In this marginal area the first lower collar part is supported on the plate 26 in the first nest 29.

On the first nest plate there are provided—as seen from the operator's side 12—behind the first nest 29 upwardly projecting stops 34 against which a ready presewn upper collar 35, which consists therefore of two layers of material with an intermediate layer therebetween, is laid as a result of which it moves into the desired position relative to the first lower collar part 30. Stops 34 of this type are not situated in the area in which the upper collar 35 and the first lower collar part 30 are to be sewn together. In this area the upper collar 35 projects over the first lower collar part 30 to such an extent that it is also situated above the recess 32 in the plate 26.

When seen from the operator's side 12, a fixing device 36 for a shirt body 37 is situated in front of the first nest 29. This fixing device 36 comprises an adhesive strip 39, which is fitted on the plate 26 in a corresponding cutout 38 in the first nest plate 28, an adhesive tape or the like. This fixing device 36 is situated in the plane of the first nest plate 28. A shirt body 37 is fixed on this device after insertion of the upper collar 35 so that its shirt body margin 40, which is sewn together with the first lower collar part 30, also lies above the first nest 29 and projects over the corresponding part of the edge 33 of the recess 32 in the plate 26.

A second nest plate 41 is pivotably linked to the web 25 of the frame 21 by means of hinges 42. It is pivotable between an upper position—shown in FIG. 4—and a lower position—shown in FIGS. 5 and 6. It has clearance cuts 43 for receiving stops 34. In addition, it has a recess forming a second nest 44. The path of the edge 45 of this second nest 44 corresponds exactly to the outer form of a second lower collar part 46 and lies flush—if naturally also with spacing—above the first nest 29. The underside 47 of the second nest plate 41 presses the upper collar 35 and that part of the shirt body 37 overlapped hereby on to the first nest plate 28. The second lower collar part 46 is inserted into this second nest 44 so that now, as shown in the view in FIG. 5, all the parts which are to be sewn together are arranged in the workpiece holder 20 and aligned with one another.

Figure 4:
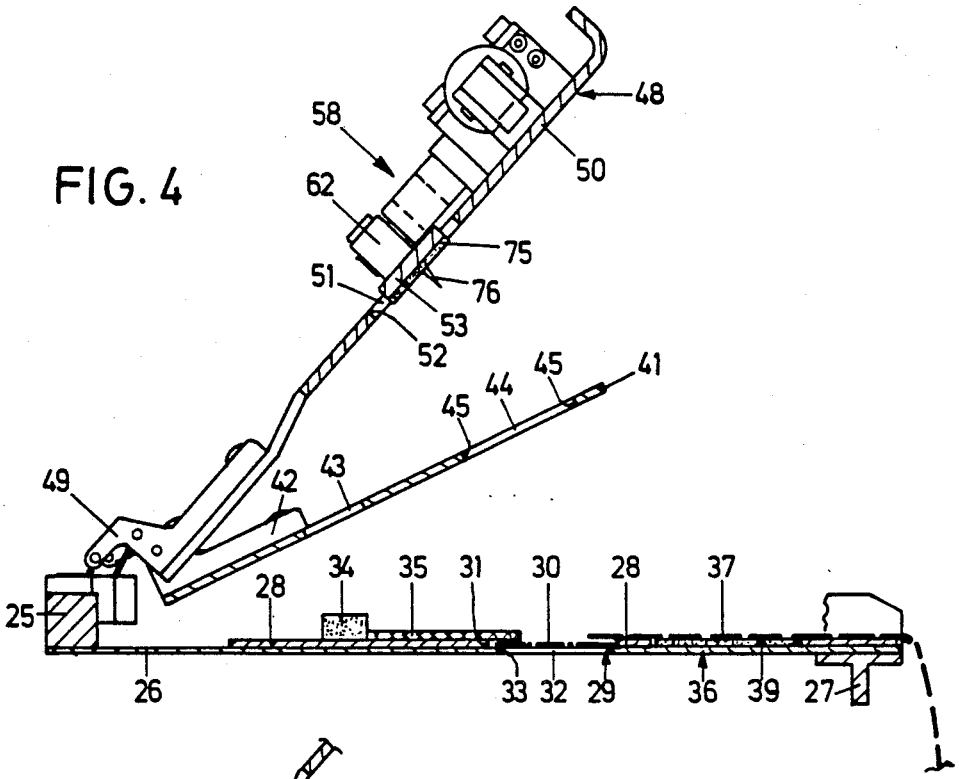
FIG. 4 is a vertical cross-section through the workpiece holder with an upwardly pivoted second nest plate and an upwardly pivoted supporting frame.
Figure 6:
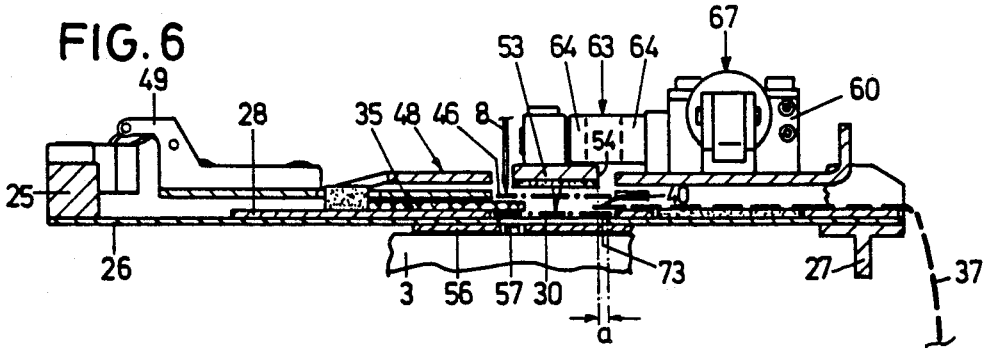
FIG. 6 is a vertical partial cross-section through the workpiece holder, with the second nest plate having been lowered and the supporting frame lowered.

Also, a supporting frame 48 is articulated on the web 25 of the frame 21 by means of hinges 49 and can be pivoted between an upper position—shown in FIG. 4—and a lower position—shown in FIG. 6. The hinges 42 and 49 are designed in a known manner as is customary with door hinges for furniture which have namely two lock-in positions in which they are retained against a certain preset force of an integrated spring. The hinges 42 or 49 are therefore designed in such a manner that they retain the second nest plate 41 and supporting frame 48, respectively, in each upper position against the forces being applied. In each respective lower position the second nest plate 41 and the supporting frame 48 exert a certain downward pressure. The supporting frame 48 has a plate 50 provided with a recess 51, the edge 52 of which in turn lies flush with respect to the edge 31 of the first nest 29 and to the edge 45 of the second nest 44.

An island-shaped holding plate 53 is also formed on the supporting frame 48, the edge 54 of which holding plate is equidistant from the edges 31, 33, 45, 52, this edge 54 also being separated from the edge 33 of the recess 32 in the lower plate 26 by a short distance a so that in this case there is an area not covered by a part of the workpiece holder 20 so that in this area a continuous closed seam 55, which joins together the first lower collar part 30, the upper collar 35 and the second lower collar part 46, on the one hand, and the shirt body 37, on the other hand, can be sewn. With the aid of the holding plate 53 the second lower collar part 46 lying above is pressed on to the upper collar 35 and the shirt body margin 40 and again on to the first lower collar part 30 lying below. If—as indicated in FIG. 6—there is provided a supporting slider 56 bearing against the underside of the plate 26, then the workpieces are clamped between this supporting slider 56 and the holding plate 53. The design of such a supporting slider 56 is known from the already previously mentioned U.S. Pat. No. 4,696,242, to which specific reference may be made in this connection. The design of this supporting slider does not form part of this invention. A tubular stud 57 of the base plate 3 through which the needle 8 enters the base plate 3 is indicated in FIG. 6.

Figure 2:
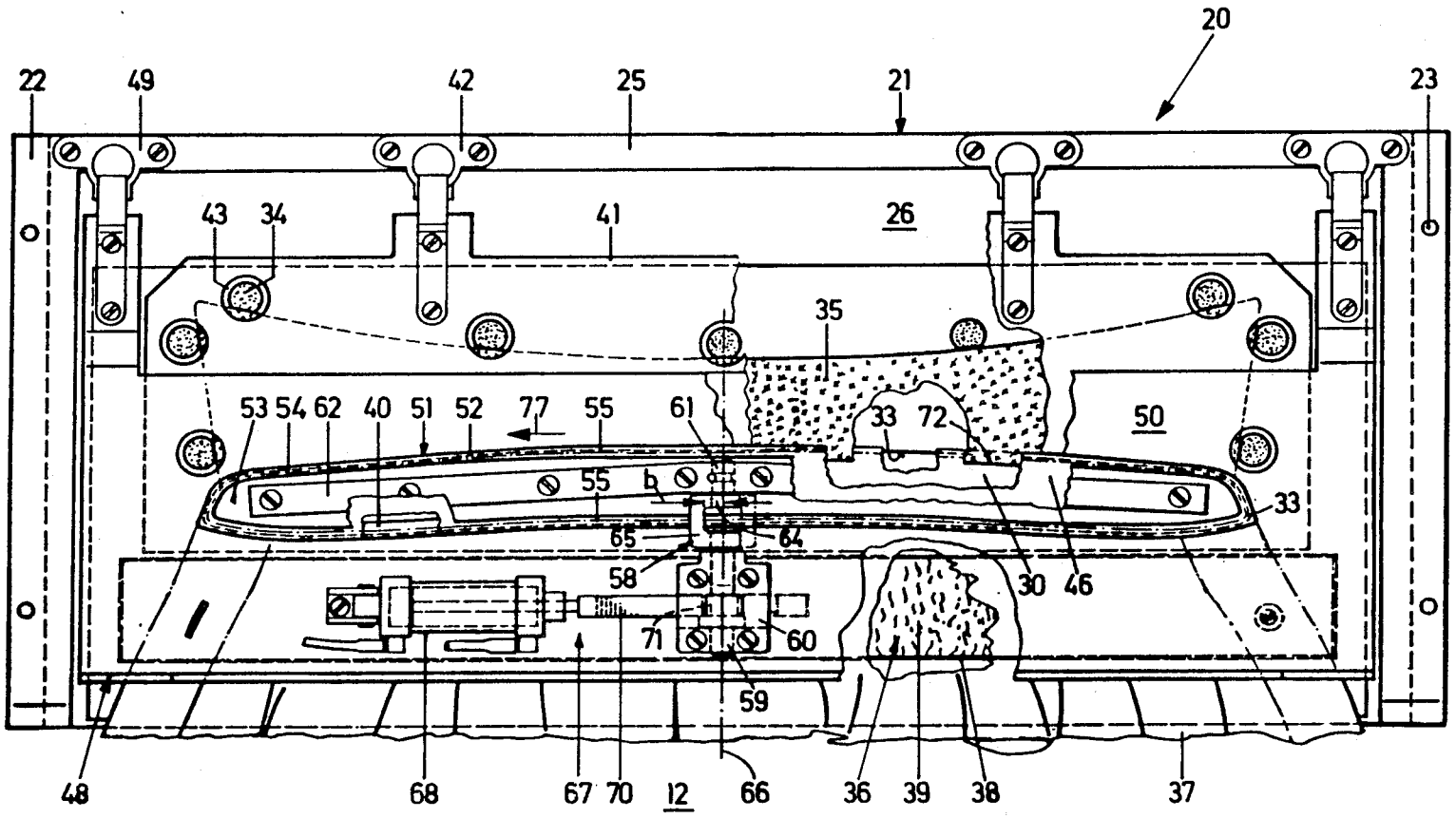
FIG. 2 is a plan view of a workpiece holder for the sewing machine according to FIG. 1.
Figure 3:
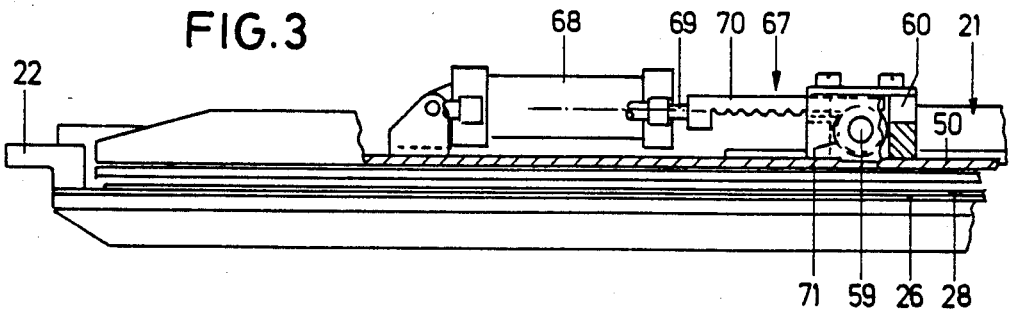
FIG. 3 is a partial front view of the workpiece holder in the direction of arrow III in FIG. 2.

The holding plate 53 is retained on the supporting frame 48 by means of a supporting bracket 58 which is designed like a crankshaft. A lug 59 of this supporting bracket 58 is mounted rotatably in a double bearing 60 which is attached to the upper side of the supporting frame 48. A lug 61 situated at the other end of the supporting bracket 58 is pivotably mounted in a carrier 62 which is fixed on the holding plate 53 and at the same time serves to reinforce this plate. Between the two lugs 59, 61 there is formed a U-shaped bracket 63, the side walls 64 of which receive between them the edge 54 of the holding plate 53 and the edge 52 of the recess 51 and thus also all the other edges 31, 33, 45. The web 65 connecting the side walls 64 runs parallel to the swivel axis of the U-shaped bracket 63 extending through the lugs 59, 61, the clearance b between the web 65 and the swivel axis 66 being approximately 5 to 10 mm. The supporting bracket 58 is pivotable about its swivel axis 66 through 180°, that is between two positions in which the side pieces 64 are each arranged in the x-y plane. These two positions which are shown in FIG. 2—by an unbroken line on the left and a dot-dash line on the right—define an area with the length b in which the seam 55 can be produced with an overlap at its beginning and end, e.g. for locking purposes.

To enable the supporting bracket 58 to be pivoted, a tilt drive 67 is formed on the supporting frame 48 which has a pneumatically actuatable piston/cylinder drive 68, on the piston rod 69 of which a gear racket 70 is mounted. A pinion 71, which is rigidly mounted in the double bearing 60 on the lug 59 of the supporting bracket 58, engages in this gear racket 70. The stroke of the piston cylinder drive 68, on the one hand, and the diameter of the pinion 71, on the other hand, are designed in such a manner that the supporting bracket 58 executes the described 180° swivel movement exactly.

Figure 7:
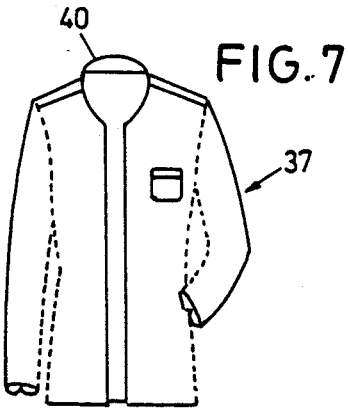
FIG. 7 shows a shirt body.
Figure 8:
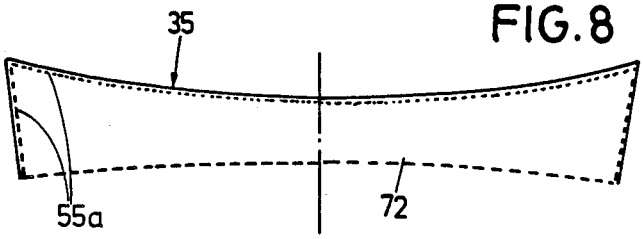
FIG. 8 shows an upper collar.
Figure 9:
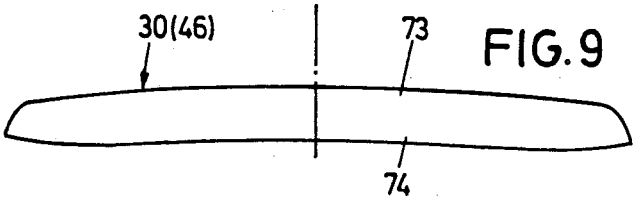
FIG. 9 shows a lower collar part.

FIG. 7 shows a shirt body 37, to the margin 40 of which the already prefabricated upper collar 35 (see FIG. 8) is to be connected by means of the identical first and second lower collar parts 30, 46 which are shown in FIG. 9, are identical and therefore shown only once. In this case the marginal zone 72 of the upper collar 35 is sewn together with the respective marginal zones 73 of the two lower collar parts 30, 46, whilst that marginal zone 74 of the lower collar parts 30, 46 which lies opposite the marginal zone 73 is connected to the shirt body margin 40.

In order to prevent slipping of the upper second lower collar part 46 relative to the holding plate 53, the latter is provided on its underside with an adhesive cover 75. This adhesive cover 75 can be made for example of foam rubber. In addition, it is possible to provide on the underside of the holding plate 53 needles 76 which pass through the two lower collar parts 30, 46 and thus also secure them to prevent displacement relative to one another and relative to the clamped workpieces, namely the upper collar 35 and the shirt body 37.

Figure 5:
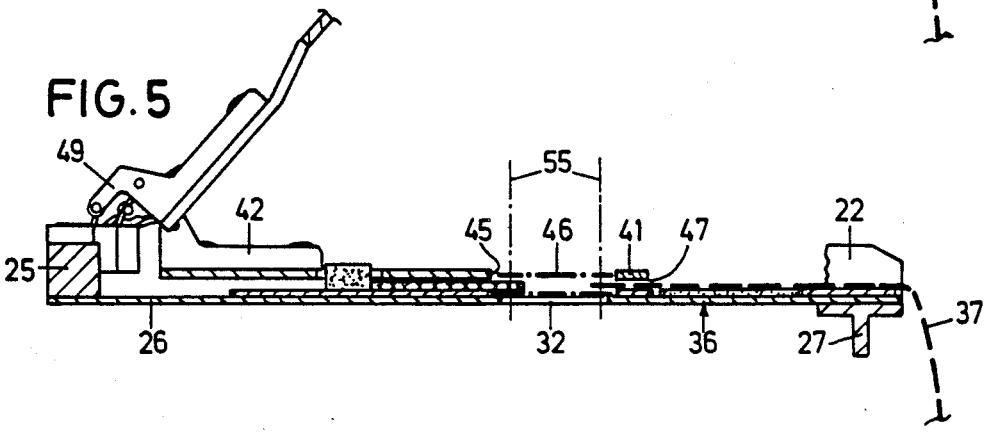
FIG. 5 is a vertical cross-section through the workpiece holder with the second nest plate having been lowered, the still upwardly pivoted supporting frame being only partly shown.

It should also be added by way of explanation that in FIG. 2 the edge 33 of the recess 32 in the lower plate 26 is shown by a dotted line, whereas the seam 55 to be produced is shown by a dot-dash line. In FIG. 5 the workpieces 30, 35, 37 and 46 are shown in cross-section, the seam 55 which is to be produced also being indicated.

After all the workpieces have been inserted in the workpiece holder 20, the sewing operation begins between the side pieces 64 of the C-shaped bracket 63, with the latter in the position shown by an unbroken line in FIG. 2. In this original position the seam is produced in an anticlockwise direction corresponding to the directional arrow 77. If the sewing head 2, together with its needle 8, has left the area of the bracket 63 by means of correspondingly controlled driving of the carriage 9, it is pivoted into the position shown by dot-dash lines in FIG. 2 so that after closure of the seam 55 the latter can be closed up to and beyond the swivel axis 66, there being—as already mentioned—a maximum overlapping section of the two seam ends having a total length of 2*b*.

If—as shown in FIG. 1—two workpiece holders 20 can be arranged in the work plate 10, a shirt body 37 provided with the upper collar 35 and the lower collar parts 30, 46 can in each change be removed from a workpiece holder 20 and the individual parts newly inserted while the sewing operation is performed in the other workpiece holder. Instead of shirt bodies 37, blouses or comparable articles of clothing can obviously be likewise provided with collars in which the collar is composed of an upper collar and two lower collar parts.

The carriage 9 with the sewing head 2 is controlled by the computer 16 to produce the seam 55.

If the body 37 is to be provided only with a stud collar or a so-called stand-up collar, an upper collar 35 is not used. The appropriate inserting operation is then omitted. The sewing operations are otherwise identical.

In particular, if—as provided in accordance with FIG. 1—two workpiece holders 20 are used on the automatic sewing machine, not only the sewing times are greatly reduced because in general only one closed seam needs to be produced, but also the times required for inserting the individual workpieces are greatly reduced because an overlapping operation is achieved.

Figure 10:
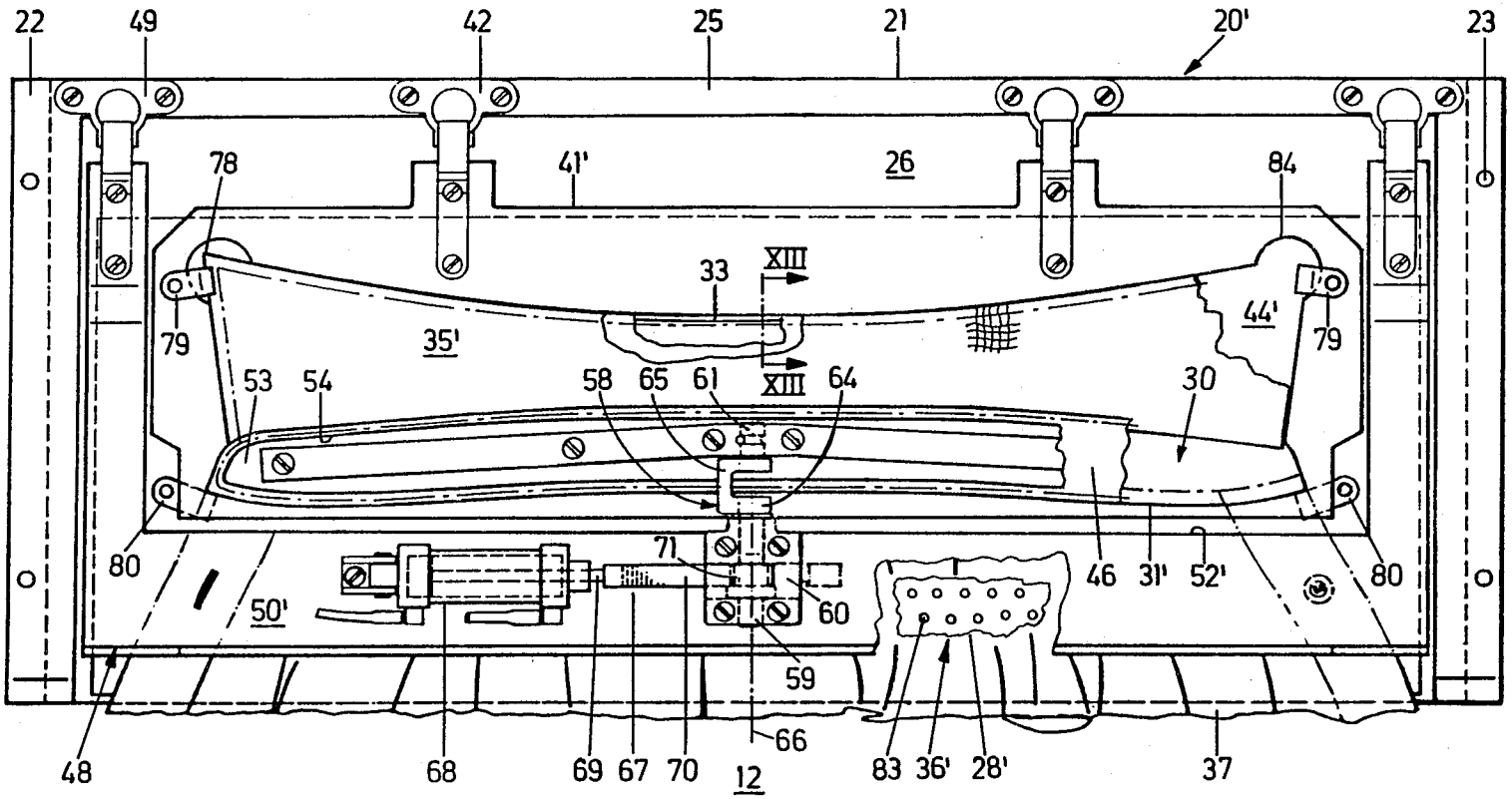
FIG. 10 is a plan view of a modified workpiece holder.
Figure 11:
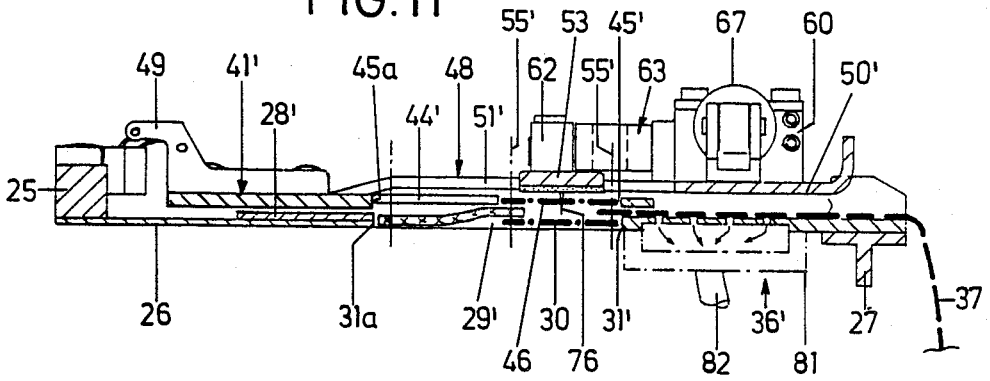
FIG. 11 is a vertical cross-section through the workpiece holder according to FIG. 10.

The embodiment of a workpiece holder 20' according to FIGS. 10 and 11 differs from the above-described workpiece holder 20 essentially in that an only in part presewn upper collar 35' is inserted, of which only the inner seam delimiting the collar edge from inside is sewn. The outer collar seam shown in FIG. 8, i.e. the so-called topstitch seam 55*a*, which is an outer visible seam, is not yet sewn. In other words this means that only the two cut collar parts have been sewn together and turned. Sewing of this topstitch seam or quilted seam, respectively, is integrated into the above-described sewing cycle. Since the workpiece holder 20' differs from the workpiece holder 20 only in some details, identical reference numerals have been used for identical parts in FIGS. 10 and 11. To the extent single parts only differ in construction but are the same in function, the same reference numerals are used with a raised stroke. In any case there is no need of a special new description; rather, attention is drawn to the preceding description.

The recess forming the first nest 29' is of such a size and shape that it can take up not only the first lower collar part 30, but also the partly prefabricated upper collar 35'. As can be seen from FIG. 10, the first lower collar part 30 rests against the edge 31' of the first nest 29' on the side facing the shirt body 37, on the one hand, and, on the other hand, it rests against the narrow sides, so that it cannot be slid into any direction, i.e. not even into the direction towards the upper collar 35'. With its three outer longitudinal edges, namely in the area not facing the first lower collar part 30, the upper collar 35' rests against an edge 31*a* of the first nest 29'. Here, too, FIG. 10 clearly shows that the upper collar 35' cannot slide in the direction of the first collar part 30.

Usually the recess 32' in the plate 26 is congruent with the edges 31' or 31*a*, respectively. An alternative will be dealt with further below.

The recess in the second nest plate 41' forming a second nest 44' has edges 45' and 45*a*, which are essentially congruent with the edges 31' or 31*a*, respectively, of the first nest 29'. So as to prevent the upper collar 39' in the second nest 44' from sliding out upwards, resilient holding clamps 79 are secured to the upper side of the second nest plate 41 adjacent to the collar tips 78, there holding the upper collar 35'. Similar holding clamps 80 are provided on the first nest plate 28' there holding in each case the outer margin of the shirt body 37. In the embodiment according to FIGS. 10 and 11 a fixing device 36' is provided for securing the shirt body 37; the fixing device 36' has a suction box 81 connected with a not shown suction source via a suction connection 82. Suction apertures 83 are provided in the first nest plate 28, so that the part of the shirt body 37 directly lying on it is held in its position by suction.

The plate 50' of the supporting frame 48 leaves free the whole area covered by the upper collar 35' and the lower collar parts 30, 46. Adjacent to the collar tips 78 the nests 29' and 44' have approximately three-quarter circle cutouts 84, serving as free cutouts for the collar tips 78, which in their outer shapings are subject to greater tolerances, so that it is possible to lay the upper collar 35 into the workpiece holder 20' without any problems.

Figure 12:
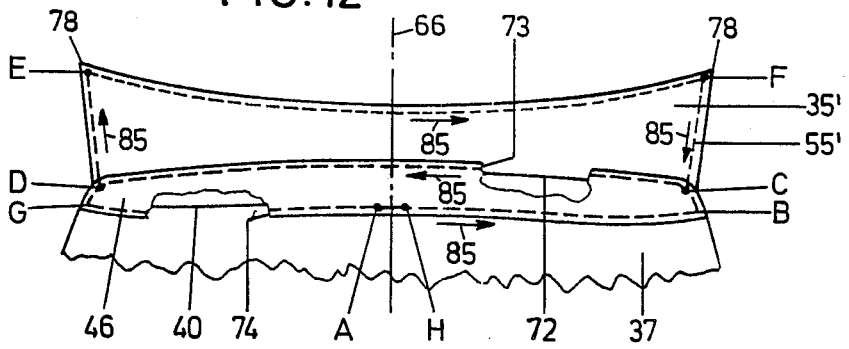
FIG. 12 shows an upper collar, the lower collar parts and a part of the body, as sewn together with only a single seam.

For sewing on an upper collar 35' and two lower collar parts 30, 46 in a single operation the three mentioned collar parts and the shirt body 37 are laid into the workpiece holder 20' in the same manner as described above. The chronological process of the sewing of a seam results from FIG. 12. The U-shaped bracket 63 is folded into the position shown in FIG. 10. Sewing start is at point A, namely between the axis of rotation 66 and the inner side of the web 65. Then a continuous seam 55' is produced according to the arrow 85 indicating the sewing direction. The seam 55' is first produced from the starting point A to the edge point B, with the two lower collar parts 30, 46 being connected with a section of the margin 40 of the shirt body 37. From the edge point B the seam 55' is continued to the edge point C, where the upper collar 35' is applied. The seam 55' is continued to the edge point D corresponding to the opposite lying application point of the upper collar 35'. The seam extending between B-C is thus only sewn between the under collar parts 30, 46, whereas the seam extending between C-D again serves to connect the upper collar 35' with the two lower collar parts 30, 46.

From point D on the seam is again sewn to point C via the edge points E and F related to the two collar tips 78. The mentioned topstitch seam 55*a* of the upper collar 35' is sewn by the seam section D-E, E-F, F-C. Subsequently, the seam section C-D is sewn once again. Thus it is sewn twice. From there a short seam section is sewn to the edge point G lying symmetrically vis-à-vis the edge point B. From there a remaining seam section is sewn past the starting point A to the point H where the sewing head 2 terminates the seam 55' by a thread-cut-off process. The point H is mirror symmetrically to the starting point A, namely mirror symmetrically to the axis of rotation 66. At the beginning of the sewing of the remaining seam section G-H, at the latest, the U-shaped bracket 63 has been tilted by 180° through activation of the tilt drive 67.

As explained the seam section C-D is sewn twice. In case this sewing twice is not desired, it is necessary for the sewing head 2 to perform an interim thread-cut-off process at point C without any sewing taking place from point C to point D, so that then the seam 55' can be completed from point D to point G and finally to point H.

Figure 13:
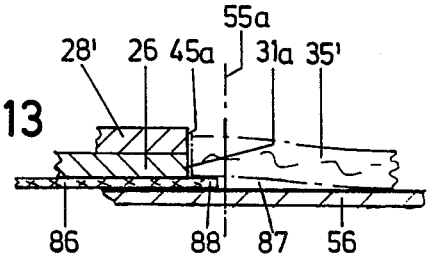
FIG. 13 is a partial view according to line XIII—XIII in FIG. 11 on an enlarged scale with a modification of the workpiece holder.

A supporting slider—not shown in FIG. 11—can be provided for sewing as indicated in FIG. 6 and as described above. Further, alternatively or cumulatively a thin lower plate 86 with a recess 87 can be provided under the plate 26. The edge 88 of this recess 87 is equidistant to the edges 31' and 31*a*—as can be seen from FIG. 13—in each case on the outside of the path of the seam 55*a*, so that on the one hand the upper collar 35' and the first lower collar part 30 can ly on this narrow edge 88 without impeding the sewing process. This lower plate 86 can consist of sufficiently rigid plastic material or of metal sheeth. In each case it is very thin, for example approximately 0.5 mm thick. Also the holding clamps 79 and 80 engage outside of the to be produced seam 55*a*, as can be seen from FIG. 10.

What is claimed is:

1. Method of sewing a collar, formed by two lower collar parts (30, 46) and an upper collar (35, 35') on to a body (37) of an article of clothing, particularly a shirt or a blouse, comprising the following steps:

a margin (40) of the body (37) of the article of clothing is arranged and held between associated marginal zones (74) of the lower collar parts (30, 46) and sewn thereto; and marginal zones (74) of the lower collar parts (30, 46) which are remote from the margin (40) of the body (37) are sewn together, between which marginal zones (74) a marginal zone (72) of an upper collar (35, 35') is arranged and held prior to sewing;

wherein the margin (40) of the body (37) is arranged between the associated marginal zones (74) of the two lower collar parts (30, 46) prior to sewing, and subsequently sewing takes place with only one closed seam (55, 55'), thereby connecting the body (37), the two lower collar parts (30, 46) and the upper collar part (55, 55').

2. Method according to claim 1, comprising the following steps:

a first lower collar part (30) is positioned;

subsequently the margin (40) of the body (37) is laid over the associated marginal zone (74) of the first lower collar part (30);

a marginal zone (72) of the upper collar (35, 35') is laid over an associated marginal zone (73) of the first lower collar part (30);

the body (37) and the upper collar (35, 35') are secured to prevent slipping;

a second lower collar part (46) is positioned over the margin (40) of the body (37) and over the marginal zone (72) of the upper collar (35, 35') and the closed seam (55, 55') is produced.

3. Method according to claim 1, wherein an only in part prefabricated upper collar (35') is arranged and held prior to sewing between the marginal zones (74) of the lower collar parts (30, 46) and wherein a topstitch seam (55*a*) of the upper collar (35') is sewn together with the closed seam (55') in a single sewing operation.

4. Method according to claim 3, wherein the closed seam (55') is sewn starting from a starting point (A) between the lower collar parts (30, 46) and the body (37) along a seam section (A-B) between the lower collar parts (30, 46) and the body (37), the continuing along a seam section (B-C) on the lower collar parts (30, 46), from there along a seam section (C-D) between the lower collar parts (30, 46) and the upper collar (35'), from there along three seam section (D-E, E-F, F-C) corresponding to the topstitch seam (55*a*) of the upper collar (35'), from there bridging the seam section (C-D) between the lower collar parts (30, 46) and the upper collar (35'), from there along a seam section (D-G) on the lower collar parts (30, 46), and from there along a seam section (G-H) between the lower collar parts (30, 46) and the body (37), right to the vicinity of the starting point (A).

5. Method according to claim 4, wherein the seam section (C-D) between the lower collar parts (30, 46) and the upper collar (35') is once again sewn during bridging this seam section (C-D).

6. Method according to claim 1, wherein the closed seam (55, 55') is sewn continuously.

7. Method of sewing a collar, formed by two lower collar parts (30, 46) on to a body (37) of an article of clothing, particularly a shirt or a blouse comprising the following steps:

a margin (40) of the body (37) of the article of clothing is arranged and held between associated marginal zones (74) of the lower collar parts (30, 46) and sewn thereto; and marginal zones (73) of the lower collar parts (30, 46) which are remote from the margin (40) of the body (37) are sewn together;

wherein the margin (40) of the body (37) is arranged between the associated marginal zones (74) of the two lower collar parts (30, 46) prior to sewing, and subsequently sewing takes place with only one continuous closed seam (55), thereby connecting the body (37) and the two lower collar parts (30, 46).

8. Method according to claim 7, comprising the following steps:

a first lower collar part (30) is positioned;

subsequently the margin (40) of the body (37) is laid over the associated marginal zone (74) of the first lower collar part (30);

the body (37) is secured to prevent slipping;

a second lower collar part (46) is positioned over the margin (40) of the body (37) and the seam (55) is produced.

* * * * *